United States Patent [19]

Zimmerly

[11] Patent Number: 4,623,180

[45] Date of Patent: Nov. 18, 1986

[54] CHAIN DOOR LOCK

[76] Inventor: Harold L. Zimmerly, 6047 N. Muscatel, San Gabriel, Calif. 91775

[21] Appl. No.: 712,248

[22] Filed: Mar. 15, 1985

Related U.S. Application Data

[63] Continuation-in-part of Ser. No. 658,037, Oct. 5, 1984, abandoned.

[51] Int. Cl.[4] ..... E05C 17/36

[52] U.S. Cl. ..... 292/264

[58] Field of Search ..... 292/264, 346, 281, 340

[56] References Cited

U.S. PATENT DOCUMENTS

| | | | |
|---|---|---|---|
| 1,623,050 | 4/1927 | Frantz | 292/281 |
| 2,484,024 | 10/1949 | Garberding | 292/346 |
| 3,339,963 | 9/1967 | Chambers | 292/264 |
| 3,467,428 | 9/1969 | Constable | 292/340 |
| 3,521,922 | 7/1970 | Bowling | 292/264 X |
| 3,809,418 | 5/1974 | Canfield | 292/264 |
| 3,963,269 | 6/1976 | Rosenberg | 292/346 |
| 4,073,523 | 2/1978 | Long | 292/264 |
| 4,106,800 | 8/1978 | Nakanishi | 292/264 |

*Primary Examiner*—Richard E. Moore

*Attorney, Agent, or Firm*—Christie, Parker & Hale

[57] ABSTRACT

A chain-type door lock comprising a wall bracket, door bracket and a connecting linkage is disclosed. The wall bracket comprises an L-shaped mounting plate which can be secured to the side face of a door jamb by screws and a cover plate which is mountable over the mounting plate to block access to the screws. The connecting linkage is preferably a chain which is attached at one end to one of the door or wall brackets and which has a key at its other end for engaging a slot in the other of the door or wall brackets. The slot may be vertical or horizontal.

24 Claims, 9 Drawing Figures

CHAIN DOOR LOCK

CROSS REFERENCE TO RELATED APPLICATION

This application is a continuation-in-part application of U.S. patent application Ser. No. 658,037, filed Oct. 5, 1984, and now abandoned, entitled Chair Door Lock, which is incorporated herein by reference.

FIELD OF THE INVENTION

This invention relates to door locks and more particularly to an improved chain-type door lock.

BACKGROUND OF THE INVENTION

Chain-type door locks typically comprise a door plate which is mounted on a door and a wall plate which is mounted on the wall or door jamb adjacent the door. The plates are generally secured to the door or wall by screws. The chain is fixedly attached at one end to one of the plates, e.g., the door plate, and comprises a key which can be inserted into one end of a slot in the other plate e.g., the wall plate. When the key is moved to the other end of the slot, it cannot be pulled out of the slot when the door is opened. Thus, the door can only be opened to the extent that the chain becomes taut. To open the door completely, the key of the chain must be manually moved to the opposite end of the slot and removed. Such chain-type door locks thereby allow a door to be opened a select distance to provide visual access and some physical access to the person on the other side of the door while preventing the door from being opened past the select distance.

When a chain door lock is engaged and a person attempts to open the door, the chain extending between the door and the wall plate becomes taut and forces are applied to both the door plate and the wall plate. If sufficient pressure is applied against the door, the door and/or wall plates can be pulled or torn off of the door and/or wall. This is particularly true of the wall plate since it tends to be pulled directly away from the wall along the length of the screws. Hence, a drawback to conventional chain-type door locks is that the door plate and particularly the wall plate can be pulled off the door or wall without too much difficulty.

SUMMARY OF THE INVENTION

Accordingly, there is provided an improved chain-type door lock comprising a wall bracket and a door bracket. The wall bracket has a generally L-shaped mounting plate which can be fixedly attached to a door jamb and a generally L-shaped cover plate which can be mounted over the mounting plate.

The mounting plate has a first section with front and rear edges and a second section which extends from the rear edge of the first section generally normal to the first section. The first section has at least one screw hole. The mounting plate is mounted on a door jamb by at least one screw which extends through a screw hole in the first section and into the side face of the door jamb.

The cover plate has first and second sections like the mounting plate and is mounted over and releasably secured to the mounting plate to block access to the screws securing the mounting plate to the door jamb. The cover plate is preferably secured to the mounting plate by coupling the front edge of the first section of the cover plate to the front edge of the first section of the mounting plate and by securing the second section of the cover plate to the second section of the mounting plate.

In a preferred embodiment of the invention, a flange extends outwardly from the front edge of the first section of the mounting plate. The flange comprises a slot which engages a spike which extends from the front edge of the first section of the cover plate.

The door bracket is fixedly mounted on the door. The door bracket preferably comprises a back section, which is mounted on the back surface of the door and extends to the side surface of the door and a side section which extends forwardly from the side edge of the back section along the side surface of the door. The wall bracket is secured to the door by screws, which extend through both the back section and side section and into the door. A flange may extend from the side section into the door to assist in securing the door bracket to the door.

The door lock also comprises connecting means, preferably a chain or metal band which extends between the wall bracket and door bracket and is fixedly secured at its first end to one of the door bracket or the second section of at least the mounting plate of the wall bracket and releasably secured at its second end to the other of the door bracket or the second section of the mounting plate of the wall bracket.

Preferably, the second end of the connecting means comprises a key which releasably engages a slot in either the door bracket or the second section of the wall bracket. In a particularly preferred embodiment, the connecting means comprises a key which engages a slot in both the second section of the mounting plate and the second section of the cover plate and holds the second sections of the cover plate and mounting plate together.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
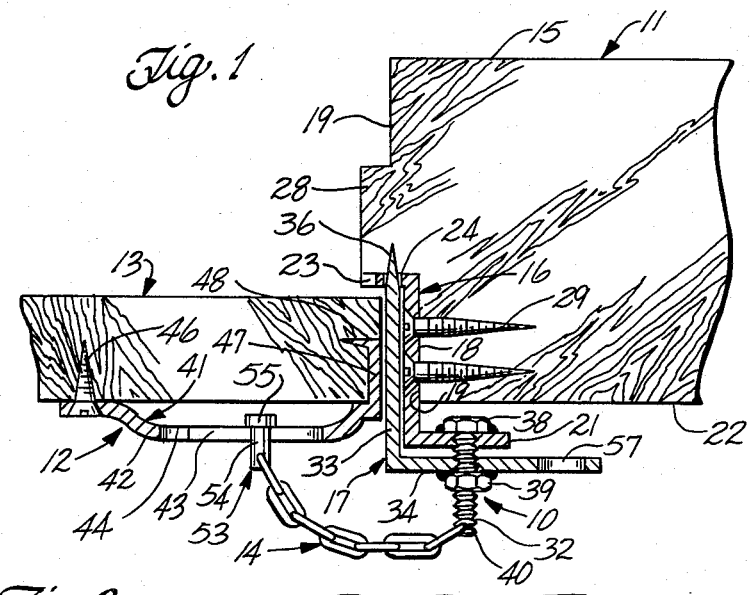
FIG. 1 is a horizontal cross-sectional view of a preferred door lock constructed in accordance with the invention.
Figure 2:
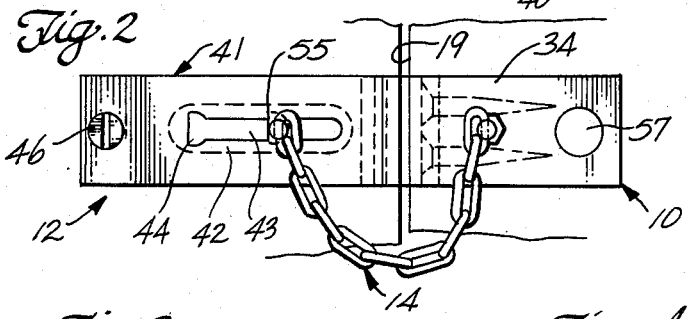
FIG. 2 is a rear view of the door lock of FIG. 1.

A preferred chain door lock constructed in accordance with the present invention is shown in FIGS. 1 and 2 and comprises a wall bracket 10, shown fixedly mounted on a door jamb 11, a door bracket 12 shown fixedly mounted on the back surface of door 13, and a chain 14 which is fixedly secured to the wall bracket 10 and releasably secured to the door bracket 12. As shown in the embodiment in FIG. 1, and as used herein, the door jamb 11 comprises front, side and rear faces 15, 19 and 22 respectively and a center molding 28.

The wall bracket 10 comprises a generally Z-shaped mounting plate 16 and a generally L-shaped cover plate 17. The mounting plate 16 comprises a generally flat middle section 18 having front and rear edges which is mounted generally flush against the side face 19 of the door jamb 11. The middle section 18 comprises a plurality of screw holes through which screws 29 extend. A generally flat rear section 21 extends from the rear edge of the middle section 18 generally parallel to the rear face 22 of the door jamb 11.

The mounting plate 16 also comprises a short flange or front section 23 which extends from the front edge of the middle section 18 generally normal to the middle section 18 away from the side face 19 of the door jamb 11. The front section 23 comprises a slot 24 adjacent the forward edge of the middle section 18. Screws 29 extend through the screw holes in the middle section 18 and into the side face 19 of the door jamb 11 to hold the mounting plate 16 in place. It is preferred that the heads of the screws 29 be flush with the outer surface of the middle section 18.

In the embodiment shown, the middle section 18 of the mounting plate 16 extends rearwardly beyond the rear edge of the side face 19 of the door jamb 11. The rear section 21 of the mounting plate 16 is thus spaced apart from the rear face 22 of the door jamb 11. The rear section 21 comprises a hole through which a stud 32 extends in a direction normal to the rear section 21 and rear face 22 of the door jamb 11.

The cover plate 17 fits over the mounting plate 16. The cover plate 17 comprises first and second sections 33 and 34 which fit in face-to-face engagement with the middle and rear sections 18 and 21 of the mounting plate 16. The first section 33 of the cover plate 17 covers the heads of the screws 29 which hold the mounting plate 16 on the door jamb 11 and thus blocks access to the screws 29 without first removing the cover plate 17.

At the front edge of the first section 33 of the cover plate 17, there is spike 36 which extends into the slot 24 in front section 23 of the mounting plate 16. The spike 36 and slot 24 arrangement prevents movement of the front edge of the cover plate 17 away from the mounting plate 16 in a direction normal to the side face 19 of the door jamb 11 and thus keeps the forward edges of the middle section 18 of the mounting plate 16 and the first section 33 of the cover plate 17 together. While not necessary, the spike 36 preferably comprises a pointed tip which extends through the slot 24 and into the center molding 28 of the door jamb 11, as shown.

The wall bracket 10 is preferably mounted in a notch in the side face 19 and outer molding 28 of the door jamb 11 so that the outer surface of the wall bracket 10 forms a continuous surface with the side face 19 and center molding of the door jamb 11, as shown in FIG. 2.

The second section 34 of the cover plate 17 also comprises a hole through which stub 32 extends. Nuts 38 and 39 are welded to one side of the mounting and cover plates 16 and 17 to hold them together and to hold the stud.

The portion of the stud 32 which extends through nut 39 comprises a hole 40 through which the link at one end of chain 14 extends, thereby fixedly securing that end of chain 14 to the wall bracket 10. The opposite end of chain 14 comprises a key 53 having a shaft 54 with an enlarged head 55 at the end of shaft 54.

The door bracket 12 is mounted on the door 13 at a position generally horizontally adjacent the wall bracket 10. The door bracket 12 comprises an elongated back section 41 which is mounted flush against the back surface of the door 13. The back section 41 extends to the edge of the door 13 adjacent the door jamb 11 and wall bracket 10. The back section 41 comprises a plurality of screw holes through which screws 46 extend into the door.

In the embodiment shown, the door bracket 12 further comprises a side section 47 which extends forwardly from the edge of the back section 41 to a position along the side surface of the door 13. The side section 47 is preferably fitted into a notch cut into the side surface of the door 13. A short, preferably tapered flange 48 extends from the forward edge of the side section 47 into the door 13. Thus the door bracket 12 is secured to the door by means of screws 46 and flange 48.

The back section 41 has a raised center section 42. An elongated generally horizontal slot 43 extends across the raised center section 42. The width of the slot 43 is greater than that of the shaft 54 of the key 53 but smaller than that of the head 55 of the key 53. At the end of the slot 43 remote from the door jamb 11 or wall bracket 10, the slot 43 has an enlarged opening 44 to allow the head 55 of the key 53 to be inserted through the opening 44. The opening 44 and the head 55 each have a flat side so that the head must be oriented properly before insertion or removal.

When the key 53 engages the slot 43 of the door bracket 12, the door 13 can be opened only until chain 14 becomes taut. The advantage of this invention is that when excessive pressure is applied to the door to open it, the wall bracket 10 on the door jamb 11 cannot be pulled off of the door jamb 11 without either shearing the screws or cracking the wood of the door jamb. Likewise, the door bracket 12 cannot be pulled off of the door without cracking it. When the key 53 is not engaged in slot 43, it can be mounted in hole 57 in the cover plate 17.

In addition, the cover plate 17 effectively prevents access to the screws 29 holding the wall bracket 10 on the door jamb 11 by a person, e.g., an intruder, who has opened the door 13 to the extent that chain 14 would allow.

Figure 3:
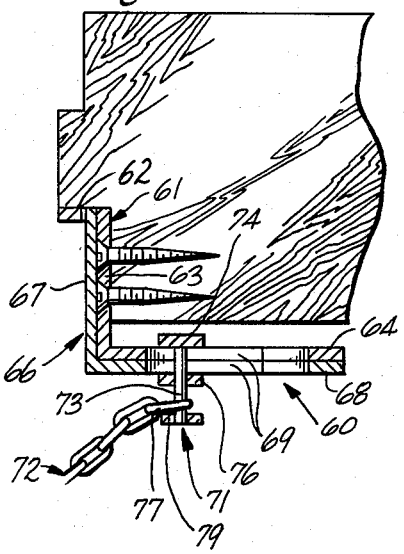
FIG. 3 is a horizontal cross-sectional view of a second preferred wall bracket.

It is apparent that many variations and modifications of the above structures may be practiced without departing from the scope of the present invention. For example, any suitable connecting means, e.g., a steel band, flexible cable, etc., can be used in lieu of a chain. Further, the chain, or other connecting means may be fixedly mounted to the door bracket rather than to the wall bracket. Such an embodiment of the invention is illustrated in FIG. 3.

In this embodiment, the wall bracket 60 again comprises a generally Z-shaped mounting plate 61 having front, middle and rear sections 62, 63 and 64 respectively and a generally L-shaped cover plate 66 having first and second sections 67 and 68. The rear section 64 of the mounting plate 61 and the second section 68 of the cover plate 66 each comprise a slot 69 through which the key 71 of chain 72 may be releasably secured.

It is preferred that the key 71 have a shaft 73, a first annular member 74 at the end of the shaft 73 and a second annular member 76 along the length of the shaft 73 spaced apart from the first annular member 74 a distance slightly greater than the thickness of the rear section 64 of the mounting plate 61 and that of the second section 68 of the cover plate 66. When the key 71 is mounted in the slot 69 and engages the wall bracket 60, the key 71 secures the cover plate 66 to the mounting plate 61.

In the embodiment shown, the shaft 73 of key 71 extends beyond the second annular member 76 and through the last link 77 of one end of the chain 72. The third annular member 79 is fixedly attached to the end of the shaft 73 to thereby secure the link 77 to the key 71.

Figure 4:
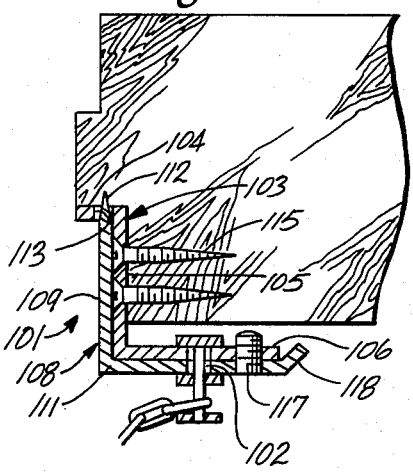
FIG. 4 is a horizontal cross-sectional view of a third preferred wall bracket.
Figure 5:
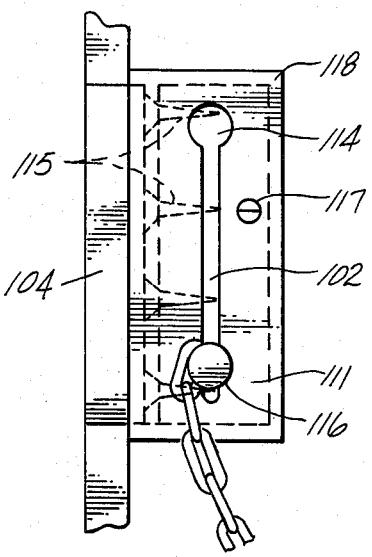
FIG. 5 is a rear view of the wall bracket of FIG. 4.

It is apparent that the slot in the wall bracket, or door bracket, need not be horizontal as shown in FIG. 3. For example, with reference to FIGS. 4 and 5, a particularly preferred embodiment of the invention is shown which comprises a wall bracket 101 having a vertical slot 102. In the embodiment shown, the wall bracket 101 comprises a generally Z-shaped mounting plate 103 having front, middle and rear sections 104, 106 and 107 respectively and a generally L-shaped cover plate 108 having first and second sections 109 and 111 respectively.

The slot 102 is formed by vertically elongated openings in the rear section 107 of the mounting plate 103 and in the second section 111 of the cover plate 108. The slot 102 has an enlarged entrance opening 114 at its upper end. Because the slot 102 is vertical, the mounting and cover plates 103 and 108 tend to be wider vertically than those wall brackets having a horizontal slot, e.g., as shown in FIG. 3. This enables the mounting plate 103 to be anchored to the door jamb with more screws 115 which makes it even more difficult for an intruder to break loose from the door jamb.

The cover plate 108 is mounted over the mounting plate 103 and held in place by spikes 112 which extend from the forward edge of the first section 109 of the cover plate 108 into holes 113 in the front section 104 of the mounting plate 103 and by the key 116 when it is inserted in the slot 102. Preferably a screw 117 is provided which extends through threaded holes in the second section 111 of the cover plate 108 and the rear section 107 of the mounting plate 103 to hold them together.

For added strength and protection, it is preferred that the cover plate comprise a flange 118 about its perimeter, except along the forward edge of the first section 109. The flange 118 extends over the edges of the mounting plate 103 and toward the door jamb or wall to further reduce access to the mounting plate.

Figure 6:
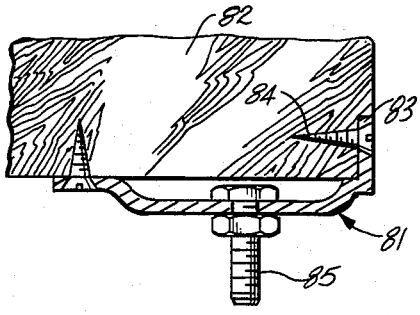
FIG. 6 is a horizontal cross-sectional view of another preferred door bracket.

The door bracket may be attached to the door by any suitable means. For example, as shown in FIG. 6, in lieu of a flange which extends into the side surface of the door 82, the side section 83 of the door bracket 81 may comprise screw holes through which screws 84 extend. A bolt 85, into which a chain 89 can be secured, extends through a hole in the wall bracket 81. Alternatively, the door bracket may simply comprise a flat plate 86 which is secured to the back surface of the door 87 by means of screws, or more preferably, by one or more bolts, such as carriage bolt 88 which extends through the door and is secured, for example, by nut 89 and locknut 90 as shown in FIG. 7.

Figure 7:
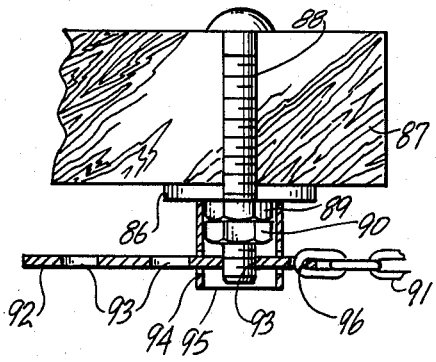
FIG. 7 is a horizontal cross-sectional view of yet another preferred door bracket.

While not required, it is preferred that bolt 85 of the embodiment shown in FIG. 6 or bolt 88 of the embodiment shown in FIG. 7 be mounted at about the same horizontal level as the slot of the wall bracket. If the wall bracket has a vertical slot, it is preferred that bolt 85 or bolt 88 be mounted at about the level of the bottom of the slot.

The chain 91 can be secured to bolt 85 or bolt 88 by any suitable means. One preferred means is shown in FIG. 7 and includes a small plate 92 having a plurality of threaded holes 93 so that the plate 92 can be threaded onto the end of bolt 88 at different locations to lengthen or shorten the overall length of the chain 91 as desired. The plate 92 passes through slots 94 in a cylindrical tube 95 which, when plate 92 is threaded onto bolt 88, is in surrounding relation to bolt 88, nut 89 and locknut 90. The tube 95 covers bolt 88 so that it cannot be unscrewed from plate 92.

The plate 92 has a second hole 96 through which the end link of the chain extends. The specific hole 93 which is used is selected so that when the chain 91 is engaged with the wall bracket (not shown), there is insufficient slack in the chain 91 to enable full rotation of the plate 92 and hence, prevents removal of the plate 92 and chain 91 from the bolt 88.

Figure 8:
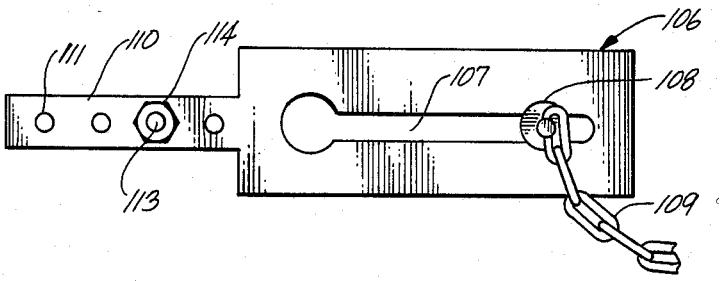
FIG. 8 is rear view of another preferred door bracket.

Rather than adjusting the length of the chain, it may be desirable to be able to adjust the distance between the door bracket and the wall bracket. For example, with reference to FIG. 8, the door bracket 106 having a slot 107 for receiving the key 108 of the chain 109 may comprise a plate 110 having a plurality of spaced apart holes 111. The door bracket 106 is mounted on the door by a bolt 113 which extends through the door and one of the holes 111 and by a nut 114. By selection of a particular hole 111, the door bracket 106 can be moved closer to or farther from the wall bracket (not shown).

Figure 9:
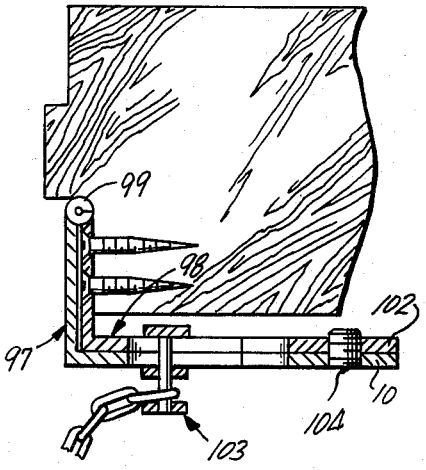
FIG. 9 is a horizontal cross-sectional view of another preferred wall bracket.

The cover plate may be secured to the mounting plate by any suitable means. For example, it is not required that the front edges of the cover plate and mounting plate be coupled in a spike and slot or hole arrangement as described above. Other coupling means may be used or no coupling means at all. For example, as shown in FIG. 9, the cover plate 97 may be connected to the mounting plate 98 at their forward edges by hinge 99. In such an embodiment, the mounting plate 98 has no front section. Further, second section 101 of the cover plate 97 may also be secured to the rear section 102 of the mounting plate 98 by any suitable means, for example, key 103. Alternatively, the second section 101 of the cover plate 97 and the rear section 102 of the mounting plate 98 may each comprise a threaded hole into which stub 104 is threaded.

Accordingly, the foregoing description should not be read as pertaining only to the precise structures and techniques described, but rather should be read consistent with and as support for the following claims which are to have their fullest fair scope.

What is claimed is:

1. A door lock comprising:

a wall bracket comprising:

a generally L-shapd mounting plate having a first section comprising front and rear edges and at least one screw hole and a second section extending from the rear edge of the first section generally normal to the first section, said mounting plate being mountable on a door jamb by means of at least one screw which can be inserted through a screw hole in the first section and into the door jamb;

a generally L-shaped cover plate having a first section comprising front and rear edges and a second section extending from the rear edge of the first section generally normal to the first section, said cover plate mountable over the mounting plate for blocking access to screws extending through the first section of the mounting plate and into the door jamb;

means for releasably securing the cover plate to the mounting plate;

a door bracket fixedly mountable on a door; and connecting means for connecting the wall bracket to the door bracket, said connecting means being fixedly attached to one of the door brackets or the second section of the mounting plate of the wall bracket and releasably attachable to the other of the door bracket or the second seciton of the mounting plate of the wall bracket.

2. A door lock as claimed in claim 1 wherein the connecting means comprises a chain.

3. A door lock as claimed in claim 1 wherein the means for releasably securing the cover plate to the mounting plate comprises:

a flange extending along the front edge of the first section of the mounting plate in a direction generally normal to the mounting plate, said flange comprising a slot adjacent the forward edge of the first section; and a spike extending forwardly from the front edge of the first section of the cover plate, said spike being insertable into said slot when the cover plate is mounted over the mounting plate.

4. A door lock as claimed in claim 1 wherein the means for releasably securing the cover plate to the mounting plate comprises a stud which extends through the second sections of both the mounting plate and cover plate and a nut threaded onto each end of the stud.

5. A door lock as claimed in claim 4 wherein the connecting means is fixedly attached to the stud.

6. A door lock as claimed in claim 1 wherein the door bracket comprises a slot and wherein the connecting means comprises a chain having a key which can be inserted into said slot for releasably engaging the door bracket.

7. A door lock as claimed in claim 1 wherein the second sections of the mounting plate and cover plate comprise a slot and wherein the connecting means comprises a key which can be inserted into said slot for releasably engaging the wall bracket.

8. A door lock as claimed in claim 7 wherein the key secures the second section of the cover plate to the second section of the mounting plate when the key is inserted in the slot.

9. A door lock as claimed in claim 1 wherein the door bracket is generally L-shaped and comprises a back section and a side section generally normal to the back section, said door bracket being mountable on a door hereby the back section engages the back surface of the door and the side section engages the side surface of the door.

10. A door lock as claimed in claim 9 further comprising means for fixedly attaching the side section of the door bracket to the side surface of the door.

11. A door lock comprising:

a wall bracket comprising:

a generally L-shaped mounting plate having a first section comprising front and rear edges and at least one screw hole and a second section extending from the rear edge of the first section generally normal to the first section, said mounting plate being mountable on a door jamb by means of at least one screw which extends through a screw hole in the first section into the side face of the door jamb;

a generally L-shaped cover plate having a first section comprising front and rear edges and a second section extending from the rear edge of the first section generally normal to the first section, said cover plate behind mountable over the mounting plate for blocking access to screws extending through the first section of the mounting plate and into the side face of the door jamb;

means for releasably securing the front edge of the first section of the cover plate to the front edge of the first section of the mounting plate;

means for releasably securing the second section of the cover plate to the second section of the mounting plate;

a door bracket mountable on a door; and connecting means for connecting the bracket to the door bracket, said connecting means being fixedly attached to one of the door bracket or the second section of the mounting plate and releasably attachable to the other of the door bracket or the second section of the mounting plate.

12. A door lock as claimed in claim 11 wherein the means for releasebly securing the front edge of the first section of the cover plate to the front edge of the first section of the mounting plate comprises:

a flange extending along the front edge of the first section of the mounting plate in a direction generally normal to the mounting plate, said flange comprising a slot adjacent the forward edge of the first section; and a spike extending forwardly from the first edge of the first section of the cover plate, said spike being insertable into said slot when the cover plate is mounted over the mounting plate.

13. A door lock as claimed in claim 11 wherein the means for releasably securing the front edge of the first section of the cover plate to the front edge of the first section of the mounting plate comprises a hinge.

14. A door lock as claimed in claim 11 wherein the means for releasably securing the second section of the cover plate to the second section of the mounting plate comprises a stud which extends through the second sections of both the mounting plate and cover plate and a nut threaded onto each end of the stud.

15. A door lock as claimed in claim 11 wherein the second sections of the mounting plate and cover plate comprise a slot and wherein the connecting means comprises a chain having a key which can be inserted into the slot for releasably engaging the wall bracket.

16. A door lock as claimed in claim 15 wherein the key secures the second section of the mounting plate when the key is inserted in the slot.

17. A door lock comprising:

a wall bracket comprising:

a generally Z-shaped mounting plate comprising a generally flat middle section having front and rear edges and at least one screw hole, a generally flat front section extending along the front edge of the middle section generally normal to the middle section and comprising a slot adjacent the front edge of the middle section, and a generally flat rear section extending along the rear edge of the middle section generally normal to the middle section and in a direction away from the front section;

a generally L-shaped cover plate comprising a generally flat first section having front and rear edges, a generally flat second section extending along the rear edge of the first section generally normal to the first section and a spike extending forwardly from the front edge of the first section;

wherein the mounting plate is mountable on a door jamb with the middle section in face-to-face engagement with the side face of the door jamb and wherein the cover plate is mountable over the mounting plate with the first section in face-to-face engagement with the middle section of the mounting plate and the second section of the cover plate in face-to-face engagement with the rear section of the mounting plate and with the spike extending into the slot;

means for securing the second section of the cover plate to the rear section of the mounting plate;

a door bracket mountable on a door comprising:

a back section for engaging the back surface of a door and a side section extending from an edge of the back section generally normal to the back section for engaging the side surface of a door;

means for attaching the back section to the back surface of a door;

means for attaching the side section of the side surface of a door; and a flexible linkage fixedly attached at one end to one of the back section of the door bracket or the rear section of the mounting plate of the wall bracket and releasably attachable at its other end to the other of the back section of the door bracket or the rear section of the mounting plate of the wall bracket.

18. A door lock as claimed in claim 17 wherein the means for releasably securing the cover plate to the mounting plate comprises a threaded stud which extends through the second sedtions of both the mounting plate and cover plate and a nut threaded onto each end of the stud.

19. A door lock as claimed in claim 17 wherein the linkage is fixedly attached to the stud.

20. A door lock as claimed in claim 19 wherein the linkage comprises a plate having a threaded hole and wherein the plate is threaded onto the stud.

21. A door lock as claimed in claim 17 wherein the second sections of the mounting plate and cover plate comprise a slot and wherein the linkage comprises a key which can be inserted into said slot for releasably engaging the wall bracket.

22. A door lock as claimed in claim 21 wherein the slot is generally horizontal.

23. A door lock as claimed in claim 21 wherein the slot is generally vertical.

24. A door lock as claimed in claim 17 wherein the cover plate comprises a flange about the portion of its perimeter adjacent the edges of the middle and rear sections of the mounting plate, said flange extending over the edges of the mounting plate and toward the door jamb.

* * * * *